US006022235A

United States Patent [19]

Zhang

[11] Patent Number: 6,022,235

[45] Date of Patent: Feb. 8, 2000

[54] ELECTRIC CONNECTOR

[76] Inventor: Ning Zhang, Room 1701, Building 9, Hetaoyuan Beili, Chao Yang District, Beijing 10020, China

[21] Appl. No.: 08/934,363

[22] Filed: Sep. 19, 1997

[30] Foreign Application Priority Data

Nov. 6, 1996 [CN] China ..... 96120295 U
Nov. 27, 1996 [CN] China ..... 96244813 U

[51] Int. Cl.[7] ..... H01R 4/50

[52] U.S. Cl. ..... 439/332; 439/334

[58] Field of Search ..... 439/332, 334, 439/671, 672, 673, 674

[56] References Cited

U.S. PATENT DOCUMENTS

| | | | |
|---|---|---|---|
| 1,299,147 | 4/1919 | Douglas | 439/672 |
| 2,437,180 | 3/1948 | Allen | 439/671 |
| 2,704,356 | 3/1955 | Herterick | 439/332 |
| 4,003,618 | 1/1977 | Booty | 439/332 |
| 5,593,324 | 1/1997 | Ito | 439/672 |

*Primary Examiner*—Hien Vu
*Attorney, Agent, or Firm*—Fulbright & Jaworski, LLP

[57] ABSTRACT

An electric connector having a first coupling member (1) and a second coupling member (2) fitted with the first member; the second coupling member (2) comprises an inserting pin (18); the inserting pin has a front end. On the outer peripheral surface of the inserting pin, a plurality of guide grooves are formed and each includes a straight section and a curved section. A metallic contact (24) is arranged at the end of each of the curved sections far away from the straight section; the first coupling member (1) includes an inserting member (4) having a hold (22), a plurality protrusions (5) formed in the hold (22) and extending radially, and metallic contacts (21). Each of the metallic contacts (21) is attached on one section of the peripheral surface of each of said protrusion (5) and faces oppositely to the opening of the hold (22). An insuring means is used to establish the effective electric contact among the metallic contacts (A, B); the protrusions (5) in the first coupling member (1) are used for moving along guide grooves (19) of the second coupling member (2) so as to act as guidance during the connection of the first coupling member (1) with the second coupling member (2), and have the same number as the guide grooves. The metallic contacts (24) of the inserting member (4) are used for electric connection with the metallic contacts (21) of the grooves (19) after the first coupling member (1) and the second coupling member (2) are inserted into and connected with each other.

4 Claims, 15 Drawing Sheets

ELECTRIC CONNECTOR

INTRODUCTION OF THE INVENTION

The present invention relates to an electric connector, and more particularly to an electric connector adapted to be a plug-socket assembly for an electric appliance, a multifuntional outlet, a cassette socket, a special movable socket etc.

BACKGROUND OF THE INVENTION

The prior electric connection method and device are of the direct plug-in type, that is, the electric power is turned on when the plug is directly inserted into the socket and the electric power is turned off when the plug is pulled out of the socket.

Although the structure of the prior electric connector is simple and easy to operate, there are the following disadvantages:

1. Since the simultaneous insertion of the terminals of the plug cannot be assured, the phenomenon "electric arcing" often takes place, electric energy is wasted and even electric accidents may occur.
2. The electric connector has a great risk. People, especially children, are electrically shocked, leading to injuries and deaths, usually due to the careless insertion, of their fingers or an electric conducting stick into the plug-in hole of the socket.
3. The electric connector has less reliability. Bad contact and even failure in contact, such as the electric separation of the plug and the socket, often happens. Therefore, it is not satisfactory in practice.

In order to overcome the disadvantages of the electric connector in the prior art, it is an object of the invention to provide an electric connector which has a simple structure and low cost, and is safe reliable and operated conveniently.

It is a further object of the invention to provide an electric connector, which has a first coupling member and a second coupling member, and in which electric connection is completed by relative rotation between the first coupling member and the second coupling member.

It is another object of the invention to provide an electric connector, which has a first coupling member and a second coupling member and in which the electric connection between the members is insured by a spring.

SUMMARY OF THE INVENTION

According to the present invention, there is provided an electric connector, comprising a first coupling member and a second coupling member fitted with said first member, characterized in that: the second coupling member comprises an inserting pin; said inserting pin has a front end; on the outer peripheral surface of the inserting pin; a plurality of guide grooves are formed, each of which includes a straight section and a curved section communicated with the straight section; the straight section extends from said front end of the inserting pin, said curved section is communicated with the straight section at its end far away from the front end of said inserting pin, and a metallic contact is arranged at the end of each of the curved sections far away from the straight section; the first coupling member comprises an inserting member having a hole, a plurality protrusions formed in the hole and extending radially, and metallic contacts; each of the metallic contacts is attached on one section of the peripheral surface of each of the protrusion and faces oppositely to the opening of the hole; an insuring means, attached in one of the coupling members and biased by the coupling members when the members are in electric connection condition to apply a pressure in the direction to separate the members so as to establish the effective electric contact among the metallic contacts; the protrusions in the first coupling member are used for moving along guide grooves of the second coupling member so as to act as guidance during the connection of the first coupling member with the second coupling member, and have the same number as said guide grooves; the metallic contacts of the inserting member are used for electric connection with the metallic contacts of the grooves after the first coupling member and the second coupling member are inserted into and connected with each other.

Preferably, the assuring means comprises a hole formed in the inserting pin, and a needle base having a stepped needle with a spring therearound and fixed in hole, whereby the pressure can be applied by the spring in such a manner that needle is inserted into the hole so that the spring biases by the front end of the second member when the members are in an electric connection condition.

Preferably, the first coupling member has a plurality of the inserting members.

Preferably, the groove is in the shape of J, U or L.

Alternatively, second coupling member further comprises an inserting member arranged inside the inserting pin, and the first coupling member further comprises an inserting pin arranged in the inserting member, which function as a needle and used for electric connection with the inserting member of the second coupling member.

Preferably, a socket cover and a socket box are used for enclosing one part of the inserting member and the needle base.

The electric connector according to the present invention can be made of various materials, such as metal, high molecular polymers etc., and can be produced through various technologies, such as molding, machining and injection molding. It is preferable to make the spring by using a spring wire. The geometrical configuration of the spring is preferably a cylinder and the elastic strength of the spring can be selected according to the practical requirement of the electric connection. The plug, the socket cover, the inserting member and the socket box are preferably made of electric insulation material (with the exception of metallic conductor pieces and metallic contacts). The inserting pins and the inserting members used in the connector for coaxial cable can also be made of metallic material, preferably of copper. The configurations of the socket cover and socket box can be changed according to the practical requirement. The socket box can have one or more holes for inlet wire and can also be produced integrally with wire.

The invention has the following advantages:

1. The electric connector according to the present invention has wide application. It can be adapted to complete the electric connection for computer, audio and video equipment, communication equipment, a radio apparatus, electronic instrument, astronavigation equipment etc., and more particularly to be the plug and the socket used in multifunctional outlet, cassette socket and special movable socket for household electric appliance.
2. The electric connector according to the present invention can assure safety, prevents from electrical shock, and is capable of greatly reducing the above mentioned "electric arcing" phenomenon.
3. The material used for the electric connector according to the present invention is easy to be obtained and manufactured. The amount of metallic material to be used to made an electric connector can be reduced and the manufacturing cost is relatively low.

4. The connecting members of the electric connector according to the present invention can be produced as a standard element so as to realize the interchangeability and common utilization.

5. The structure of the electric connector according to the present invention is simple, its operation is easy, the insertion and connection performance is reliable and the electric connection effect is satisfied.

Further objects and advantages of the invention will appear from the following description taken together with the accompanying drawings.

BRIEF DESCRIPTION OF THE ACCOMPANYING DRAWINGS

Figure 1:
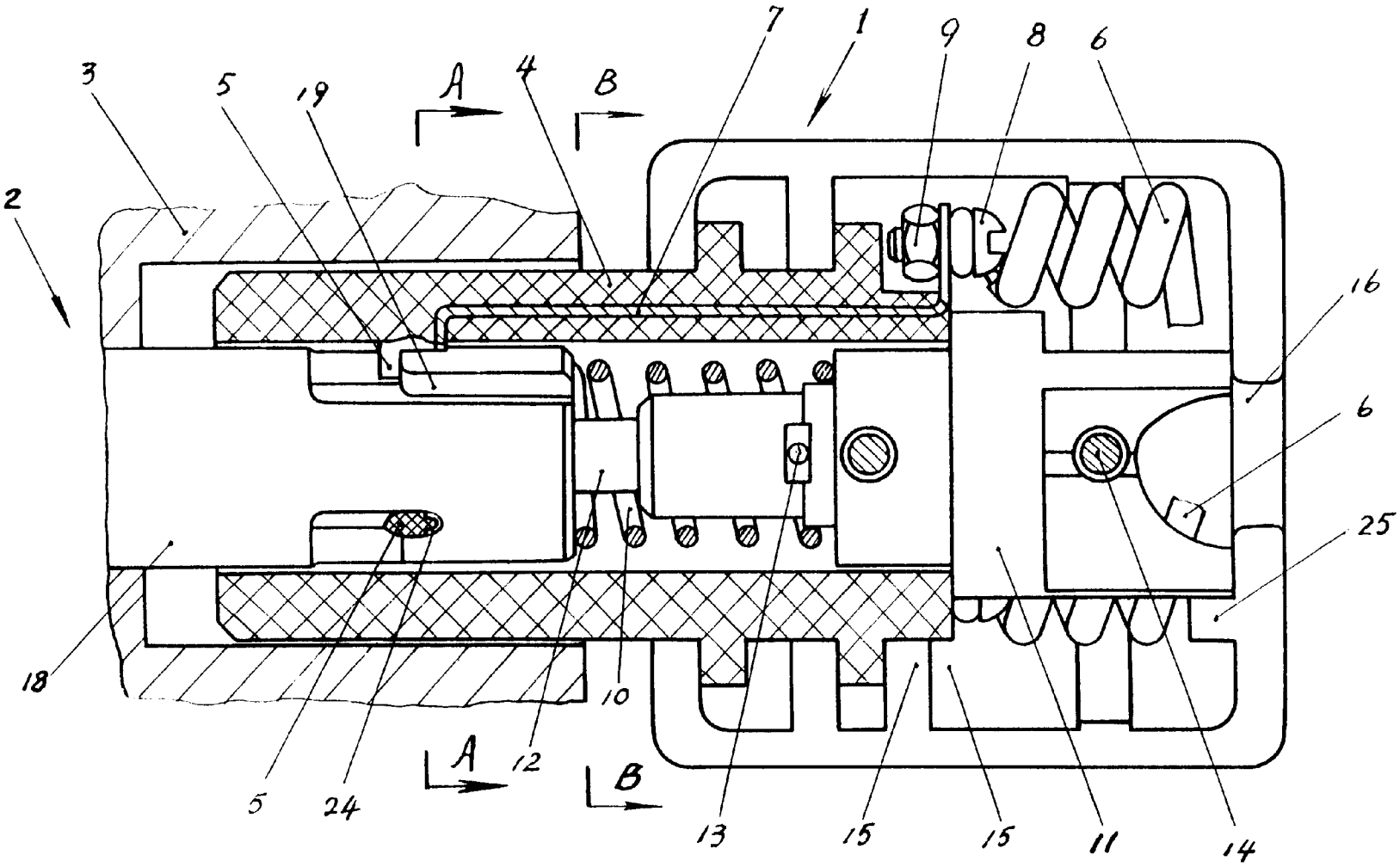
FIG. 1 is a sectional view of the first embodiment according to the present invention, wherein the plug and the socket are inserted into and connected with each other so that they are in an electrically turn-on condition.
Figure 4:
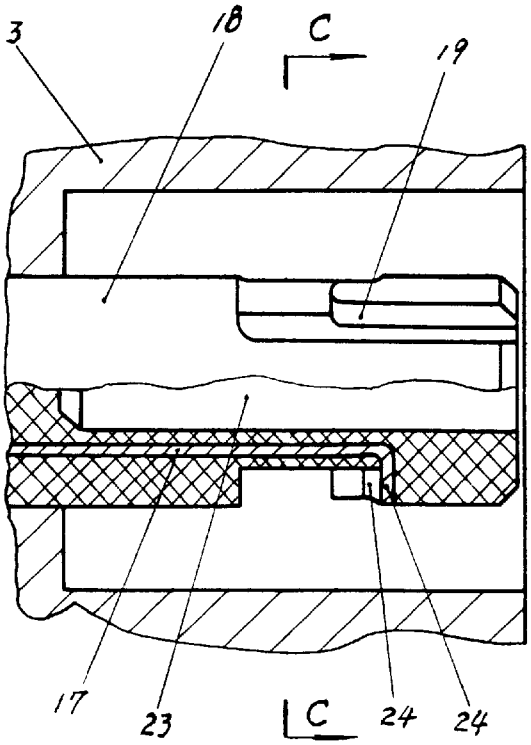

FIG. 4 if a sectional view of the inserting pin in the plug of FIG. 1.

Figure 5:
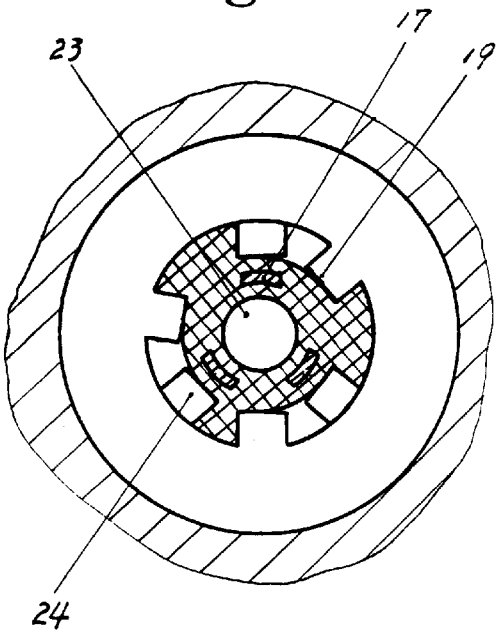

FIG. 5 is a sectional view along line C—C in FIG. 4.

Figure 7:
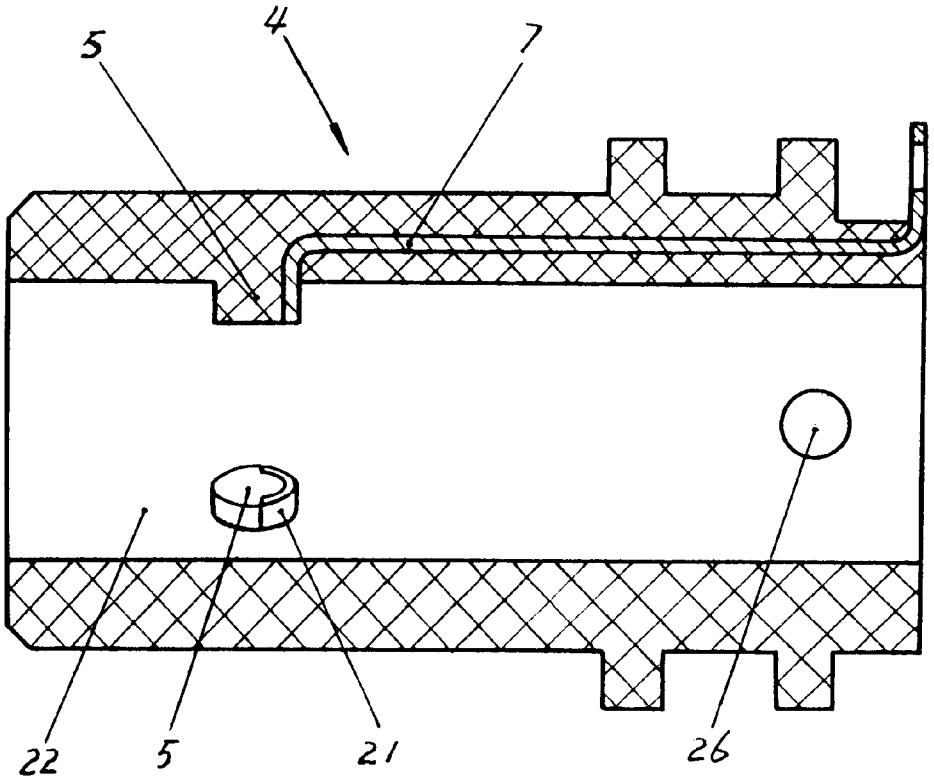
Figure 6:
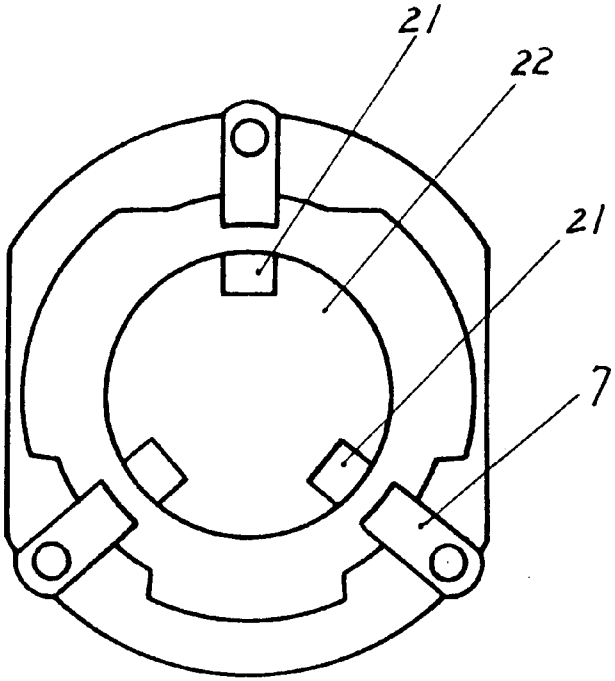

FIG. 6 is an right side view of the inserting member in FIG. 7.

FIG. 7 is a sectional view of the inserting member.

Figure 8:
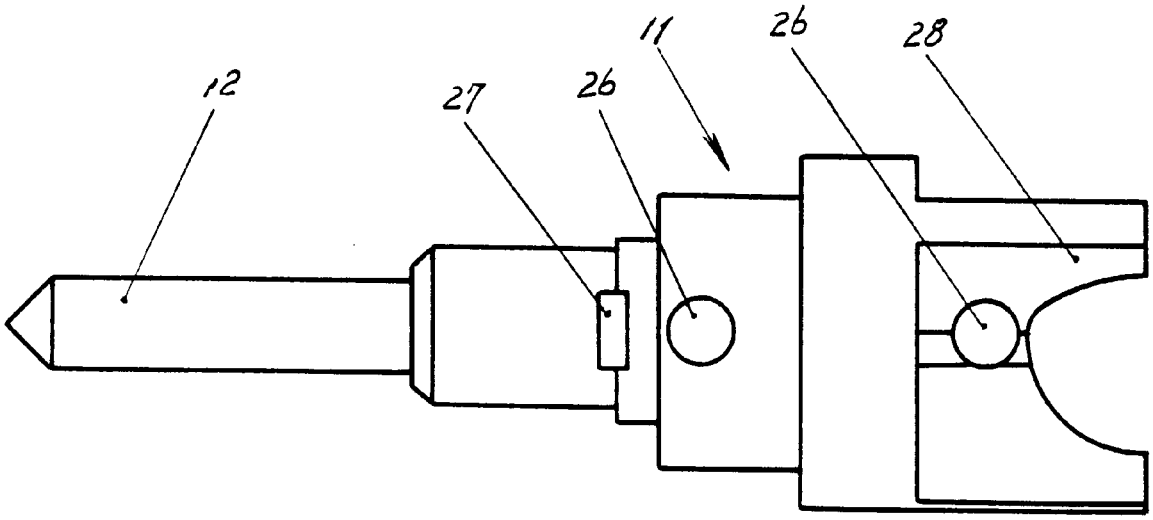

FIG. 8 is a front view of the needle base in FIG. 1.

Figure 9:
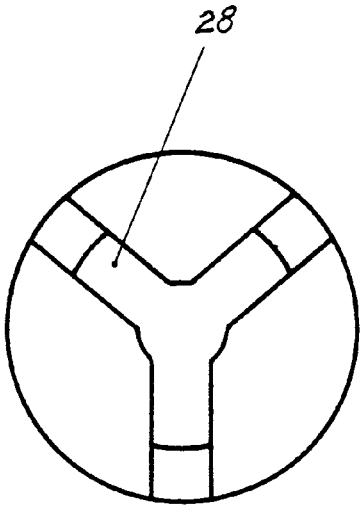

FIG. 9 is a right view of the needle base in FIG. 8.

Figure 10:
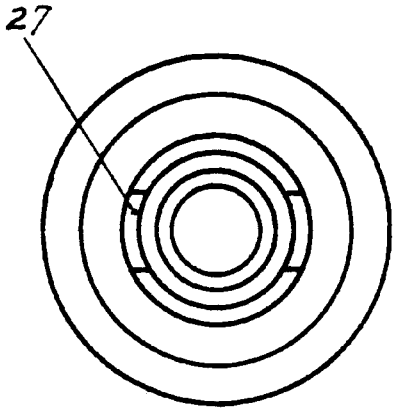

FIG. 10 is a left view in FIG. 8.

Figure 11:
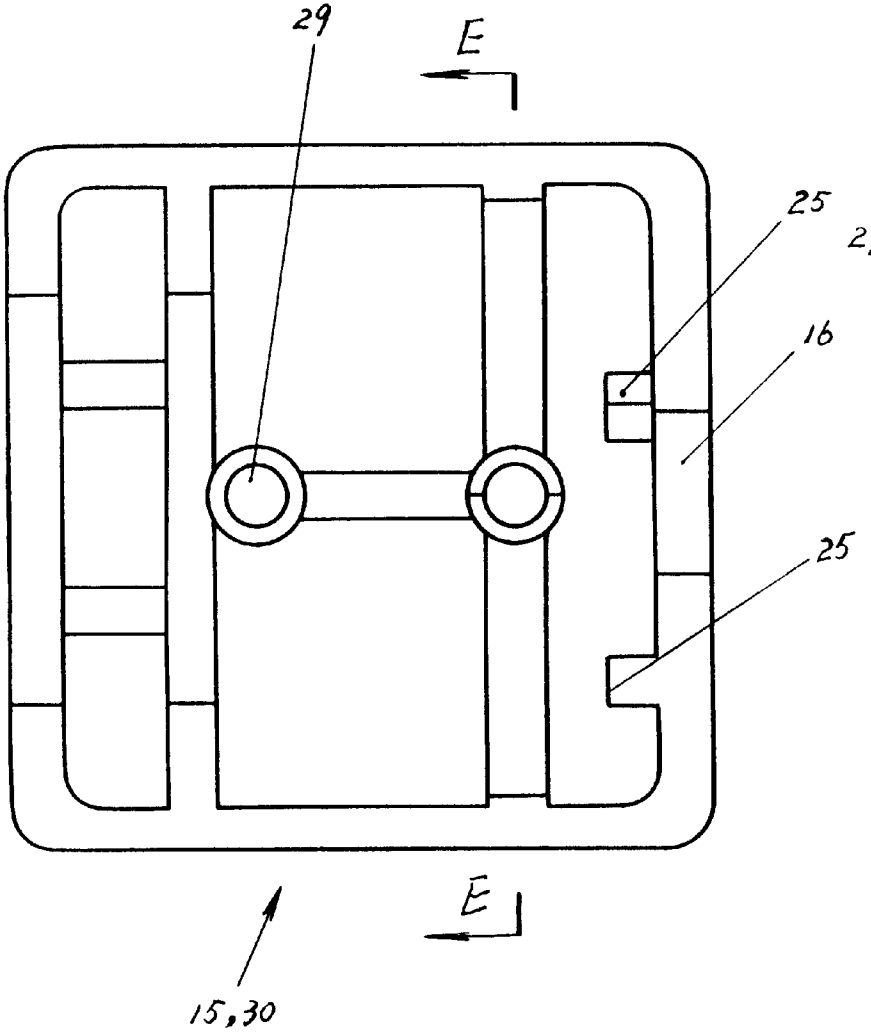

FIG. 11 is a side view of the socket cover in FIG. 1.

Figure 12:
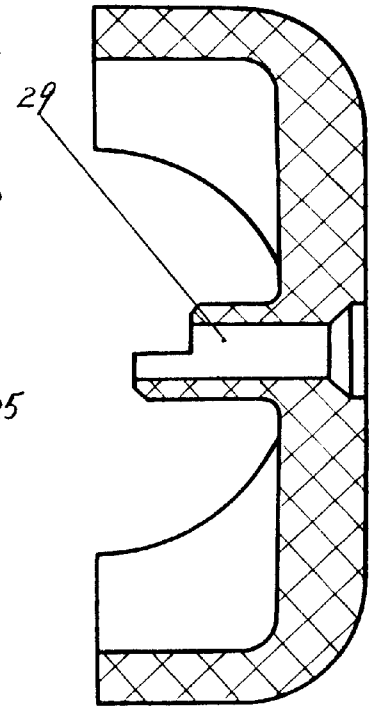

FIG. 12 is a sectional view along line E—E in FIG. 11.

Figure 13:
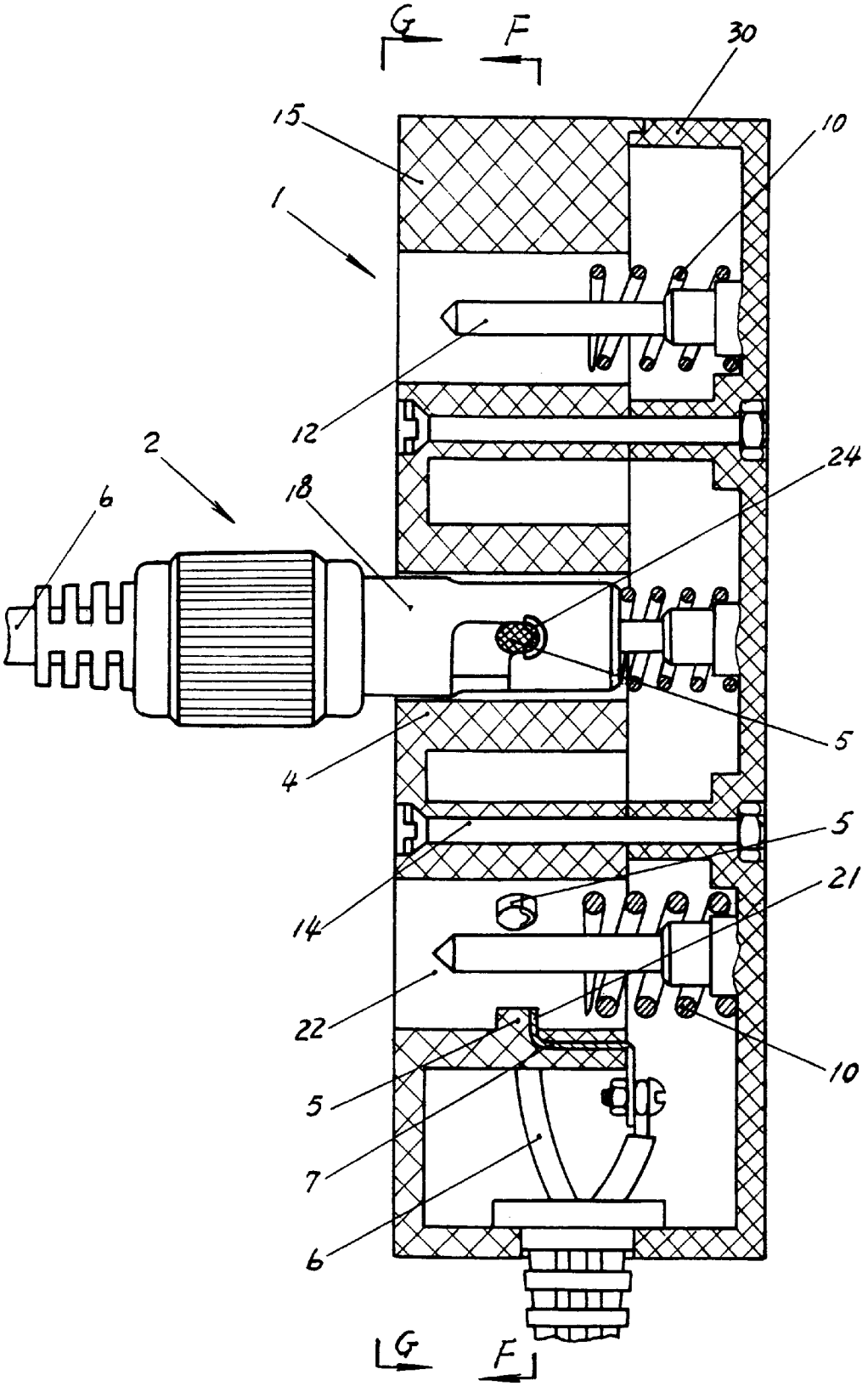

FIG. 13 is a sectional view of the second embodiment according to the present invention, wherein a plug and a socket are inserted into and connected with each other so that they are in an electrically turn-on condition.

Figure 14:
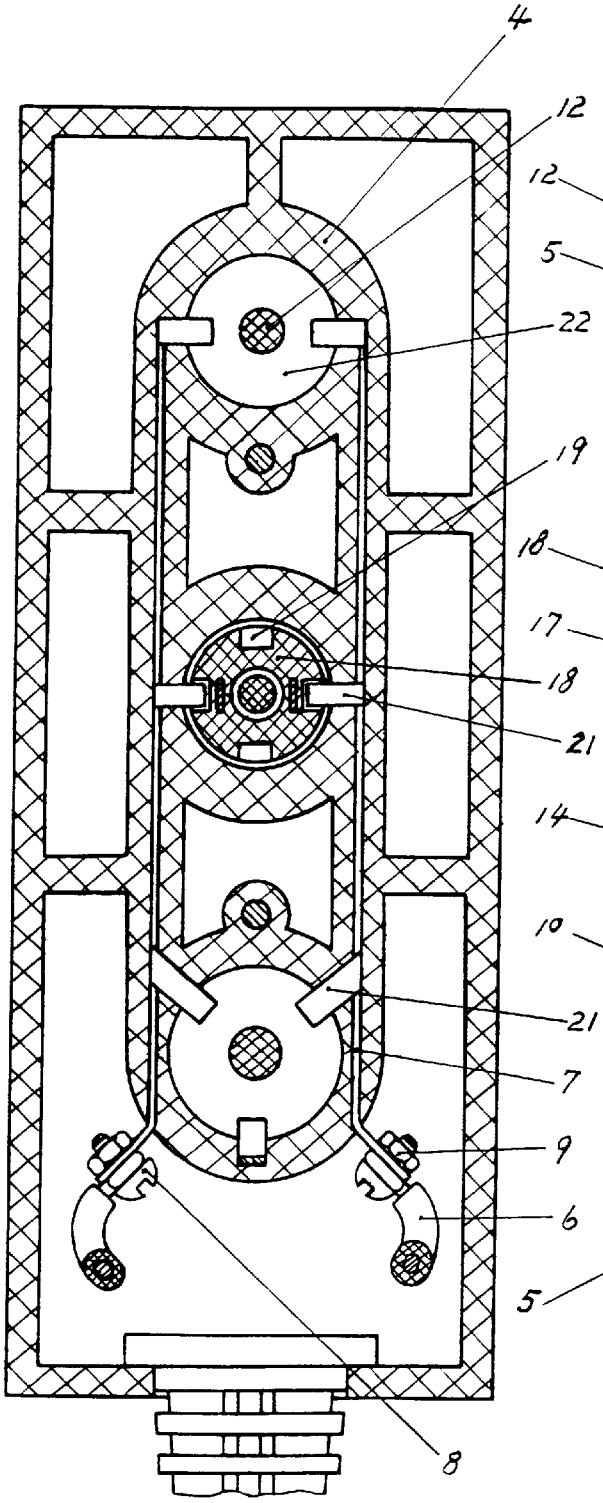

FIG. 14 is a sectional view along line F—F in FIG. 13.

Figure 15:
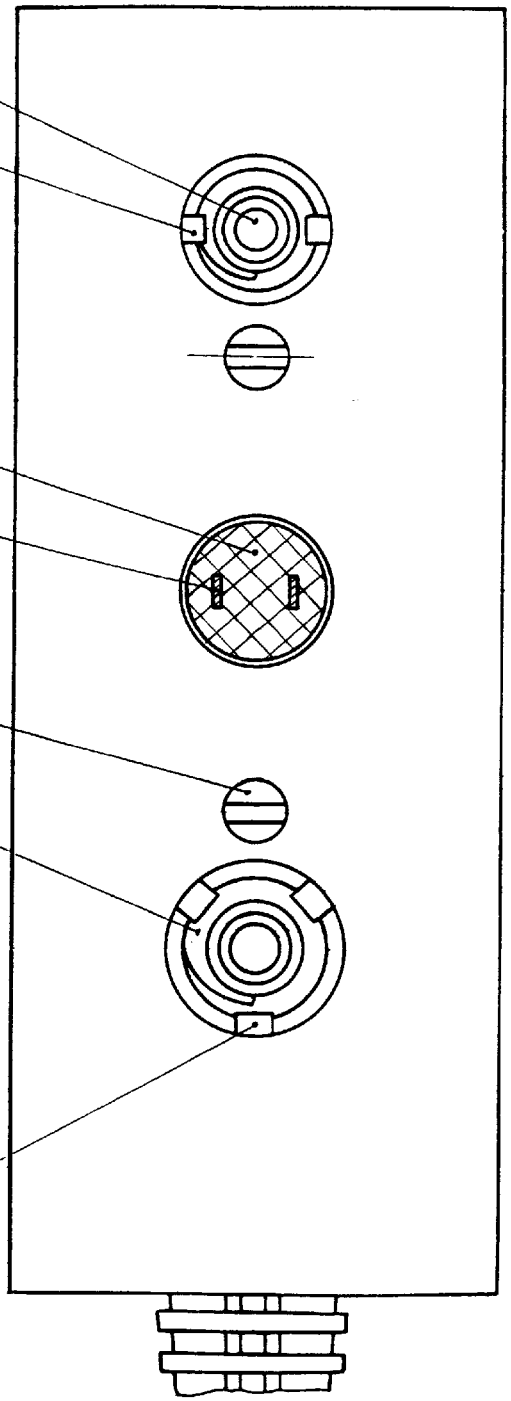

FIG. 15 is a sectional view along line G—G in FIG. 13.

Figure 16:
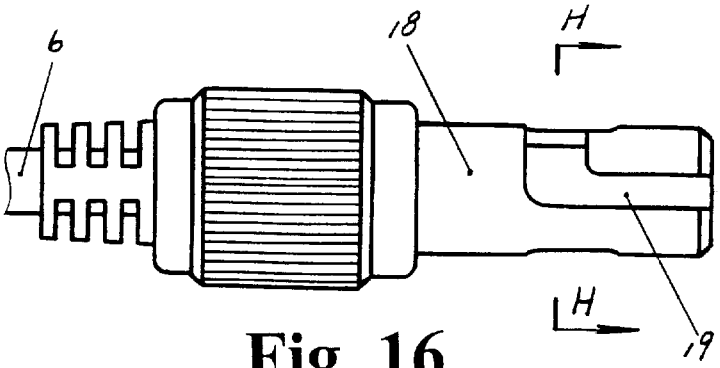

FIG. 16 is a front view of a plug which is used for matching with the socket in FIG. 13 and for connecting with a double-core wire.

Figure 17:
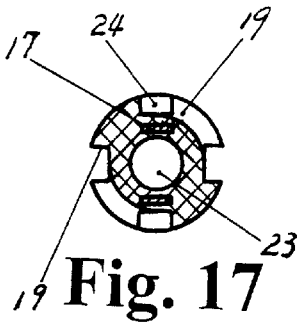

FIG. 17 is a sectional view along line H—H in FIG. 16.

Figure 18:
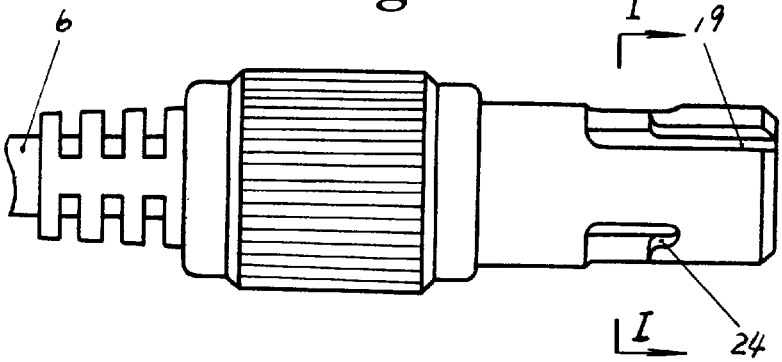

FIG. 18 is a front view of another plug which is used for matching with the socket in FIG. 13 and for connecting with a triple-core wire.

Figure 19:
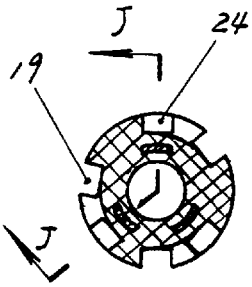

FIG. 19 is a sectional view along line I—I in FIG. 18.

Figure 20:
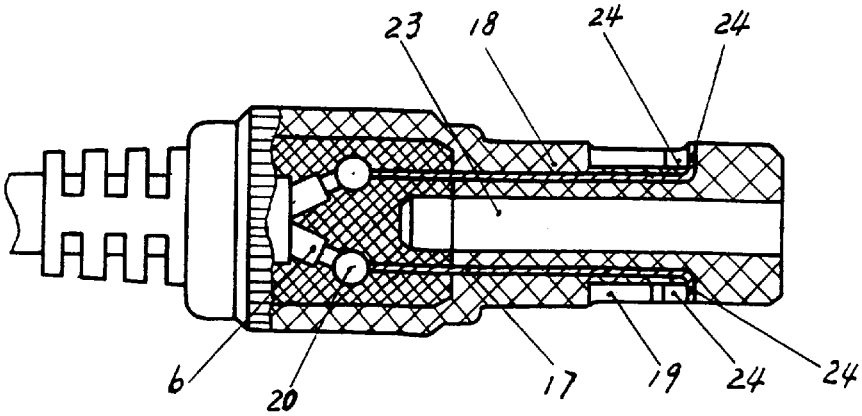

FIG. 20 is a sectional view along line J—J in FIG. 19.

Figure 21:
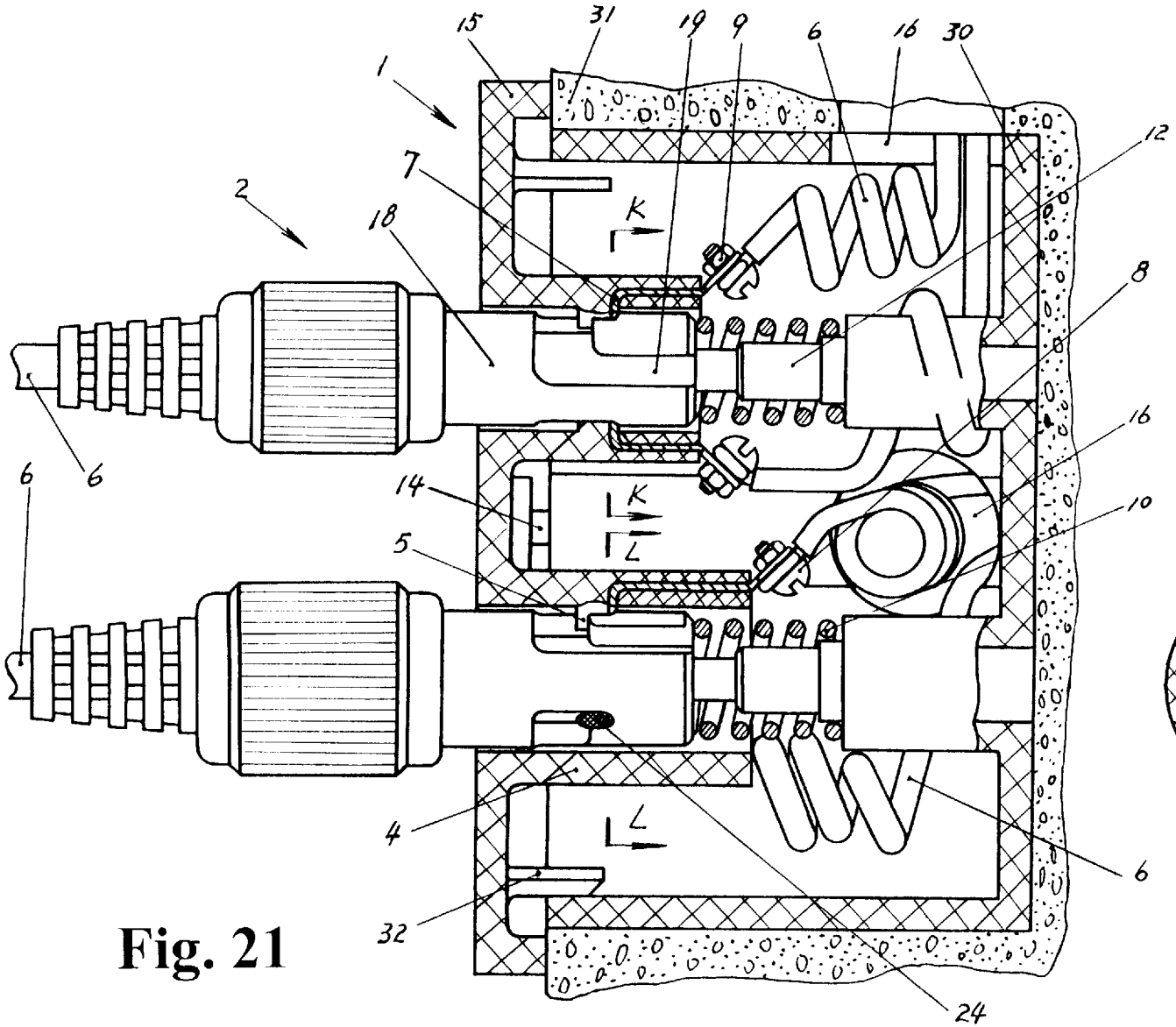

FIG. 21 is a sectional view of the third embodiment according to the present invention, wherein a plug and a socket are inserted into and connected with each other so that they are in an electrically turn-on condition.

Figure 22:
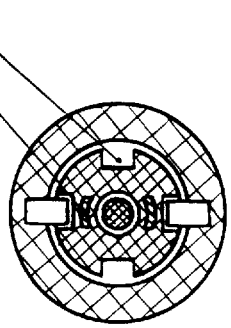

FIG. 22 is a sectional view along line K—K in FIG. 21, showing an electric connector used for a double-wre wire.

Figure 23:
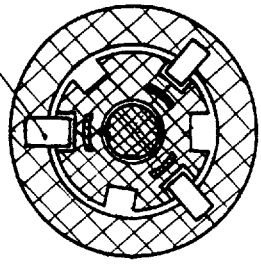

FIG. 23 is a sectional view along line L—L in FIG. 21, showing an electric connector used for a triple-core wire.

Figure 24:
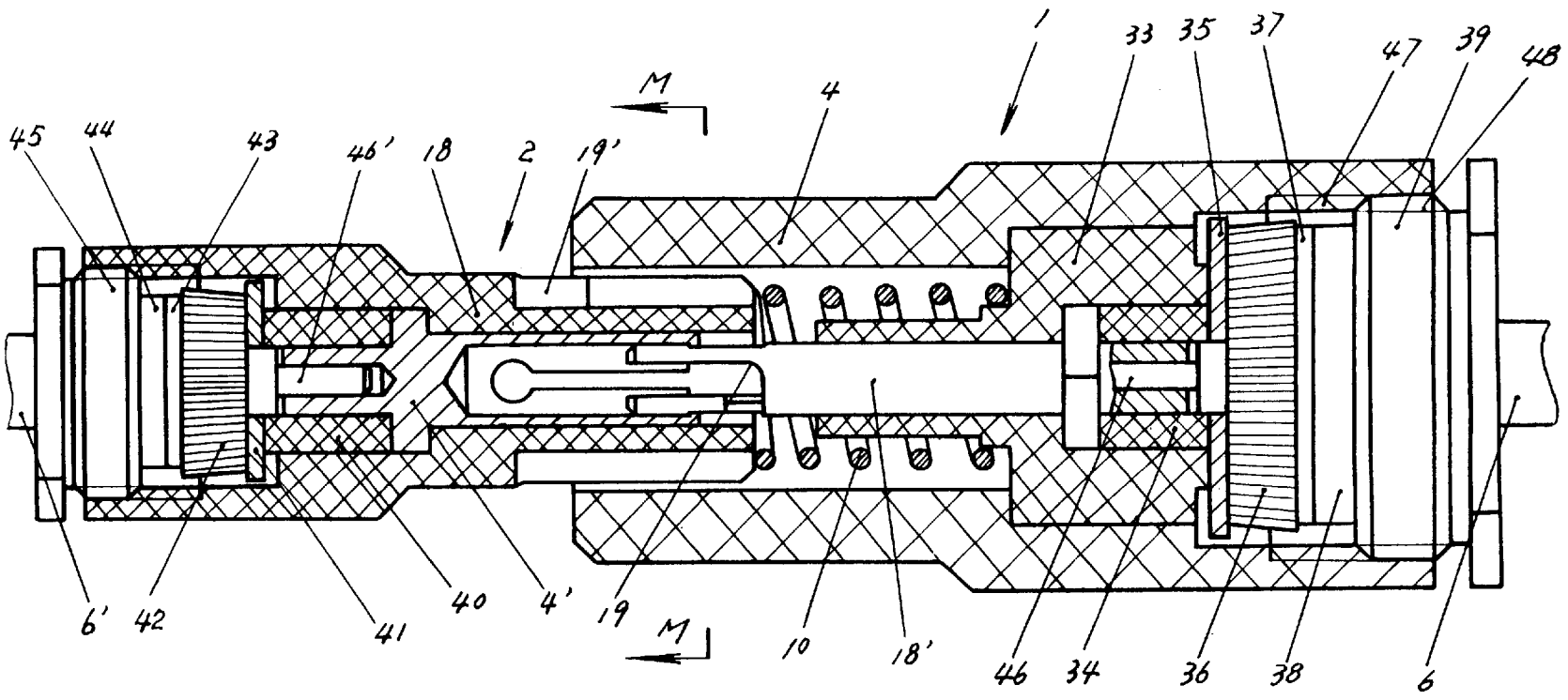

FIG. 24 is a sectional view of the fourth embodiment according to the present invention, wherein the plug and the socket are inserted into and connected with each other so that they are in an electrically turn-on condition.

Figure 25:
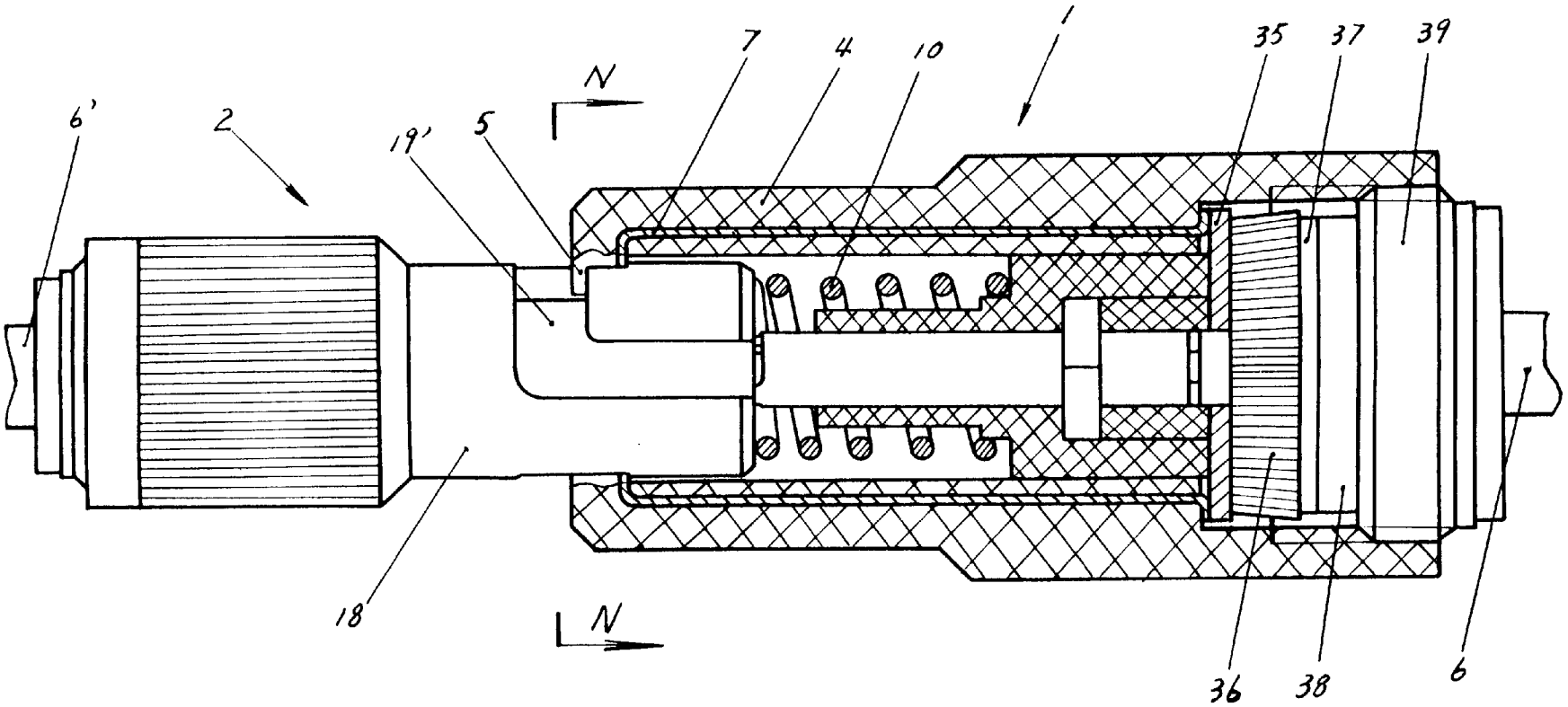

FIG. 25 is a plan view of the assembly shown in FIG. 24.

Figure 26:
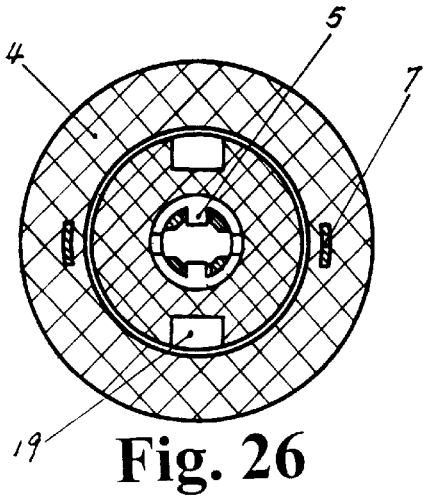

FIG. 26 is a sectional view along line M—M in FIG. 24.

Figure 27:
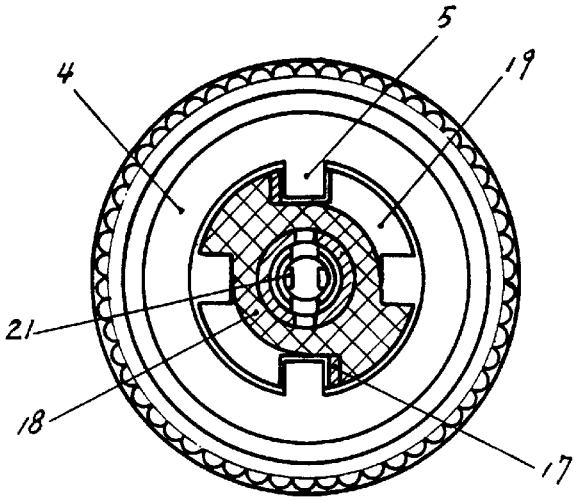

FIG. 27 is a sectional view along line N—N in FIG. 25.

Figure 28:
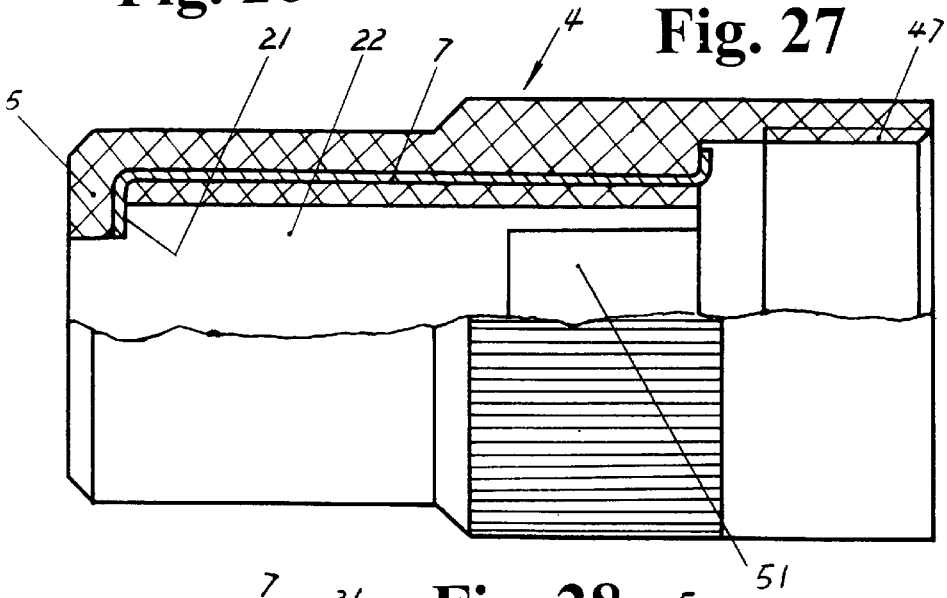

FIG. 28 is a partially sectional view of the inserting member in FIG. 24.

Figure 29:
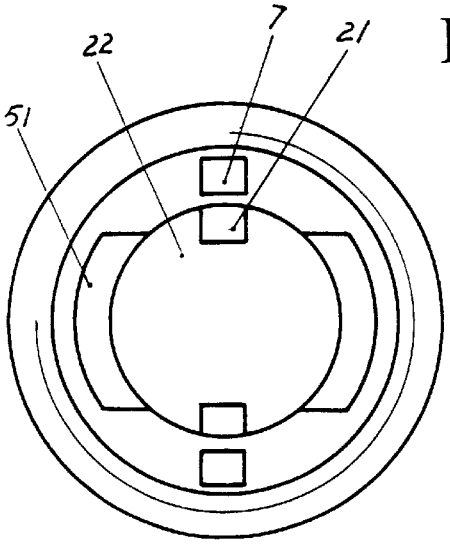

FIG. 29 is a right view of the inserting member in FIG. 28.

Figure 30:
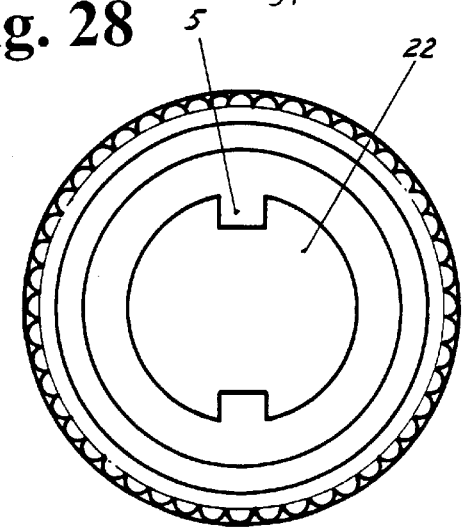

FIG. 30 is a left view of the inserting member in FIG. 28.

Figure 31:
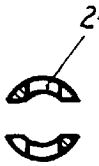
Figure 32:
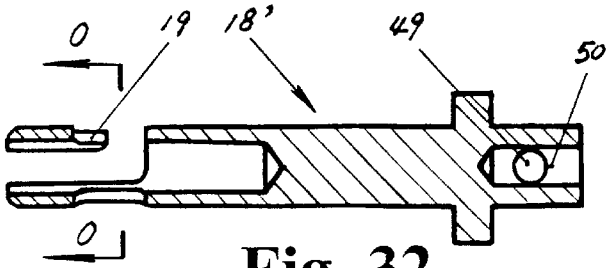

FIG. 31 is a sectional view along line O—O in FIG. 32.

FIG. 32 is a sectional view of an inserting pin of the socket in FIG. 24.

Figure 33:
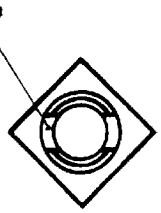

FIG. 33 is a left view of the inserting pin in FIG. 32.

Figure 34:
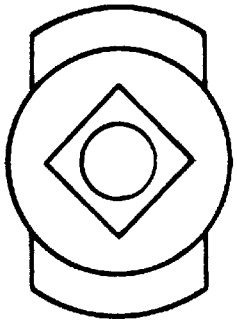
Figure 35:
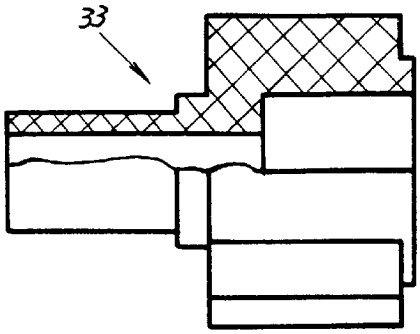

FIG. 34 is a right view of the outer insulating positioner in FIG. 35.

FIG. 35 is a partially sectional view of an outer insulating positioner of the socket in FIG. 24.

Figure 36:
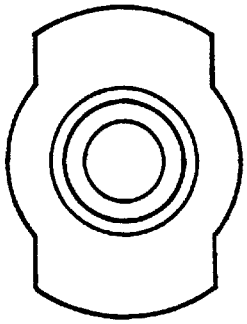

FIG. 36 is a left view of the outer insulating positioner in FIG. 35.

Figure 37:
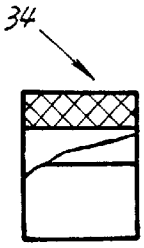

FIG. 37 is a partially sectional view of an inner insulating positioner of the socket in FIG. 24.

Figure 38:
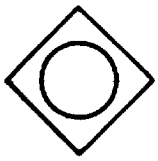

FIG. 38 is a left view of the inner insulating positioner in FIG. 37.

Figure 39:
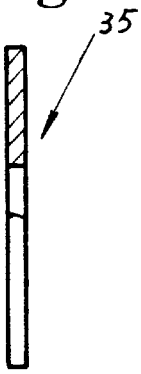

FIG. 39 is a partially sectional view of an outer conductor coupling damper of the socket in FIG. 24.

Figure 40:
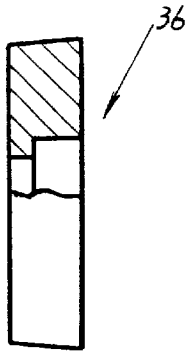

FIG. 40 is a partially sectional view of an outer conductor contacting member of the socket in FIG. 24.

Figure 41:
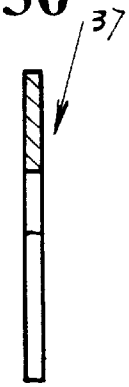

FIG. 41 is a partially sectional view of a gasket plate of the socket in FIG. 24.

Figure 42:
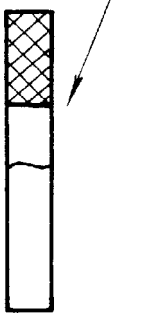

FIG. 42 is a partially sectional view of a rubber gasket of the socket in FIG. 24.

Figure 43:
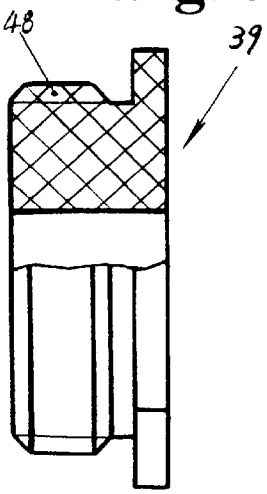

FIG. 43 is a partially sectional view of a clamping positioner of the socket in FIG. 24.

Figure 44:
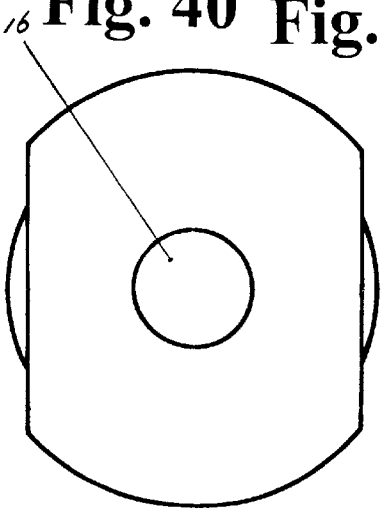

FIG. 44 is a right view of the clamping positioner in FIG. 43.

Figure 45:
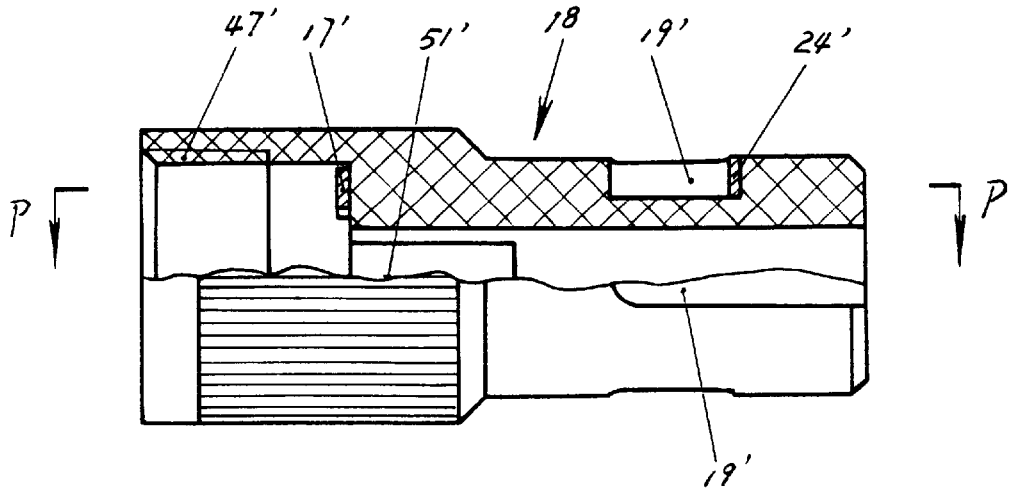

FIG. 45 is a partially sectional view of an inserting pin of the plug in FIG. 24.

Figure 46:
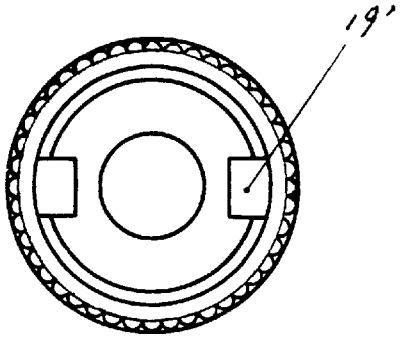

FIG. 46 is a right view of the inserting pin in FIG. 45.

Figure 47:
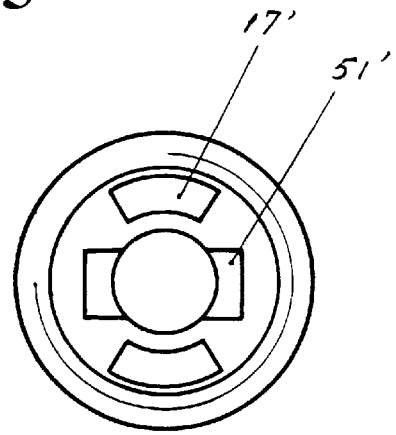

FIG. 47 is a left view of the inserting pin in FIG. 45.

Figure 48:
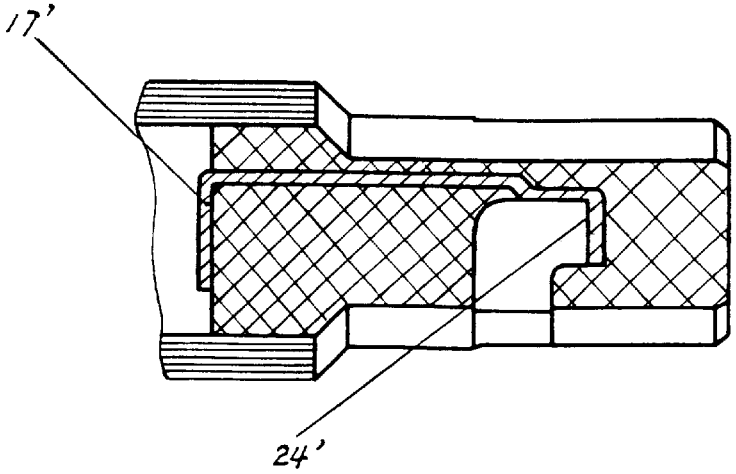

FIG. 48 is a sectional view along line P—P in FIG. 45.

Figure 49:
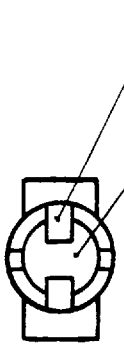
Figure 50:
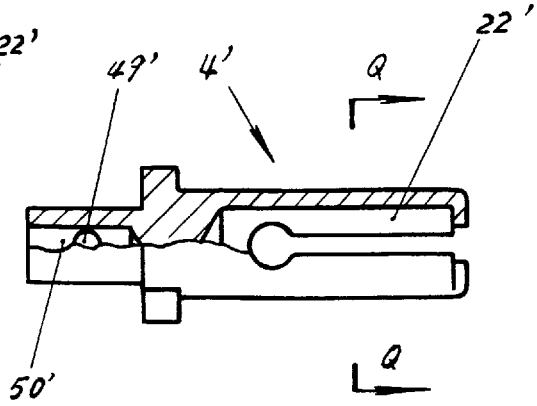

FIG. 49 is a left view of an inserting member of in FIG. 50.

FIG. 50 is a partialy sectional view of the inserting member of the plug in FIG. 24.

Figure 51:
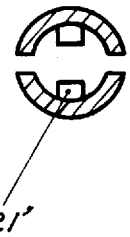

FIG. 51 is a sectional view along line Q—Q in FIG. 50.

Figure 52:
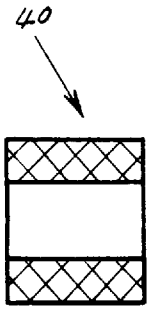

FIG. 52 is a sectional view of an insulating positioner of the plug in FIG. 24.

Figure 53:
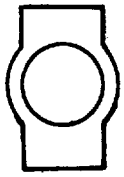

FIG. 53 is a left view of the insulating positioner in FIG. 52.

Figure 54:
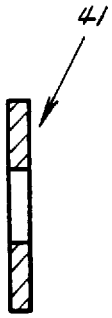

FIG. 54 is a sectional view of an outer conductor coupling eamper of the plug in FIG. 24.

Figure 55:
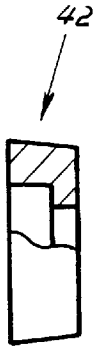

FIG. 55 is a partially sectional view of an outer conductor contacting member of the plug in FIG. 24.

Figure 56:
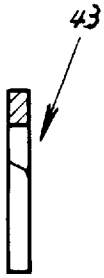

FIG. 56 is a partially sectional view of a gasket plate of the plug in FIG. 24.

Figure 57:
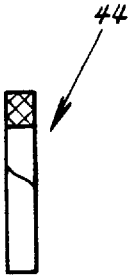

FIG. 57 is a partially sectional view of a rubber gasket of the plug in FIG. 24.

Figure 58:
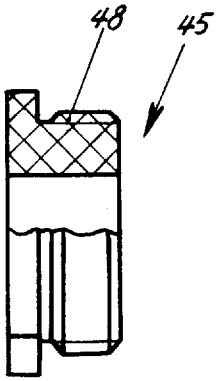

FIG. 58 is a partially sectional view of a clamping positioner of the plug in FIG. 24.

Figure 59:
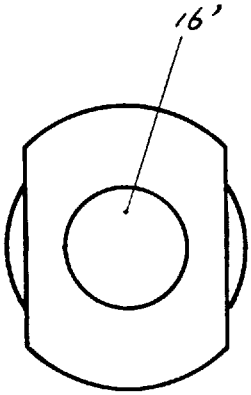

FIG. 59 is a left view of the clamping positioner in FIG. 58.

THE DETAILED DESCRIPTION OF THE PREFERRED EMBODIMENTS

In the following description of the embodiments according to the present invention with reference to the accompanying drawings, the same or similar parts in various embodiments are designated with same reference numerals. It should be also noted that the terms "plug" and "socket" below are used merely for better understanding without limitation of any kind so as to describe vividly the two coupling members which constitute the electric connector according to the present invention. Moreover, in the following description, an inserting member is defined to have protrusions and an inserting pin is defined to have guide grooves.

EMBODIMENT 1

Figure 2:
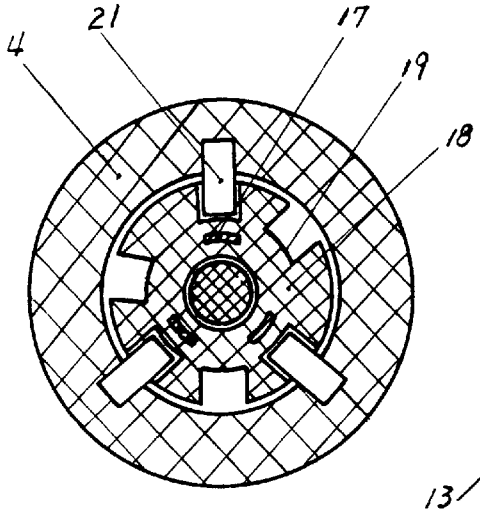
FIG. 2 is a sectional view along line A—A in FIG. 1.
Figure 3:
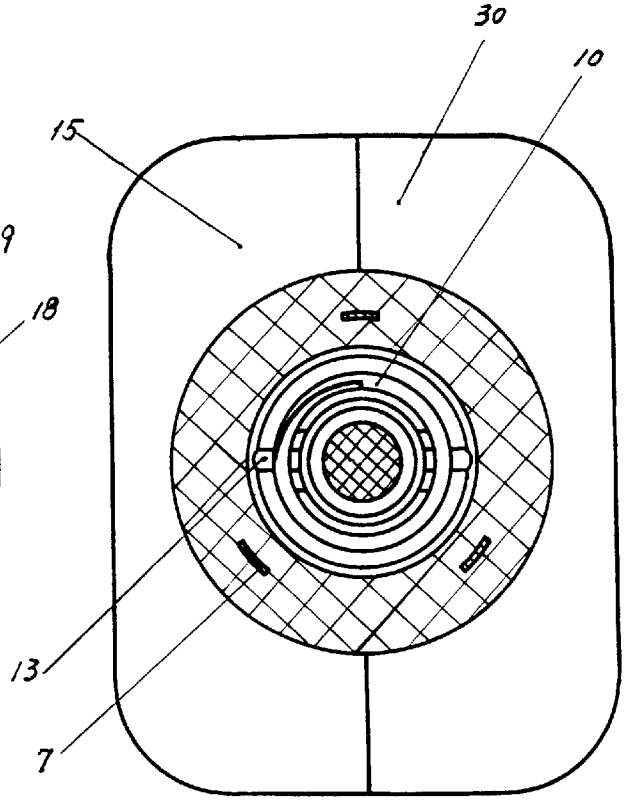
FIG. 3 is a sectional view along line B—B in FIG. 1.

FIGS. 1–12 show the first embodiment of the present invention. FIGS. 1–3 show that metallic contacts B21 of the socket are contacted with metallic contacts A24 of the plug integrated with an electric cooker 3.

The plug 2 (FIG. 1) integrated with the electric cooker 3 includes an inserting pin 18. In the inserting pin 18, there is a pin hole 23 (FIG. 4). On the outer peripheral surface of the inserting pin 18, three J-shaped guide grooves 19 are formed. Each of the grooves 19 includes a straight section and a curved section communicated with the straight section. The straight section extends from front end of the inserting pin 18 far away from the electric cooker 3 toward the electric cooker 3. The curved section is communicated with the straight section at its end far away from the front end of the inserting pin 18. A metallic contact 24 is arranged at the bottom end of each of the curved sections far away from the straight sections. The socket 1 includes an inserting member 4 which has an inserting pin hole 22 (FIGS. 6, 7), and protrusions 5 formed in the hole 22 and extending radially. A metallic contact 21 is attached to one section of the peripheral surface of each of the protrusions 5 and is toward the inner of the hole 22, as shown in FIG. 7.

A stepped needle 12 (FIG. 8) is formed on and extends from a needle base 11. A spring 10 is fitted around the needle 12. A position limitator 13 (FIG. 1) is inserted within a position limiting hole 27 (FIG. 8) to fix the spring 10 to the needle. A triple-core wire 6 which enters into the socket 1 has its three cores connected with three metallic conductor pieces 7 by respective clamping screws 8 and clamping nuts 9. The inserting member 4 seats on the needle base 11 and the hole 22 receives the needle 12 of the needle base 11. The inserting member 4 and the needle base 11 are fixed within a socket cover 15 and a socket box 30 (FIGS. 3, 11 and 12), each of which has an inlet wire half hole 16 and a coupling screw hole 29.

In the embodiment, the socket cover 15 has the same structure as the socket box 30. A wire isolating plate 28 (FIG. 9) of the needle base 11 is retained by positioning blocks 25 of the socket box 30, so that the needle base 11 is fixed in relation to the socket box 30. A part of the inserting member 4 (FIG. 1) is also retained in the socket box 30 and the socket cover 15. The socket cover 15 are attached to the socket box 30 by a coupling screw 14.

Additionally, in FIG. 4, the metallic conductor pieces in the plug 2, which are electrically connected with the metallic contacts 24, are designated by reference numeral 17. In FIG. 8, the through holes for the coupling screw 14 is designated by the reference numeral 26.

During the operation of the electric connector having the above mentioned structure according to the present invention, the operator can turn on the wire 6 of the socket 1 with the electric power, then moves the socket 1 to the plug 2, aligning the hole 22 of the inserting member 4 with the inserting pin 18, and three protrusions 5 with the grooves 19 respectively. Then, the inserting pin 18 is inserted into the hole 22 until one end of the spring 10 contacts the frond end of the inserting pin 18. Then a pressure is applied by the operator to the socket 1 so as to compress the spring 10 while the inserting pin 18 is plugged into the inserting member 4 and the needle 12 is inserted into the hole 23 under the guidance of the grooves 19 and the holes 22, 23. When the socket cover 15 is pushed to contact with the outer surface of the electric cooker 3, the protrusions 5 have been moved to the bottom ends of the straight sections of the grooves 19. Then along the paths provided by the curved sections of the grooves 19, the socket 1 is rotated in relation to the plug 2 until the protrusions 5 are moved to the bottom ends of the curved sections. Then, the pressure is released. Under the action of the recovery force of the spring 10, the socket 1 returns along the width direction of curved sections of the grooves 19 so as to make the metallic contacts 24 and the metallic contacts 21 to contact with each other, whereby the electric power is turned on.

When the socket is required to be taken off, the operator can hold the socket 1 and applies a pressure to it, making the contacts 21 of the socket 1 to leave the contacts 24 along the width direction of the grooves 19. Thus the power is turned off. Then according to the reverse sequence of the above mentioned steps, the socket 1 can be taken off from the plug 2.

It should be noted that in the above description, the electric connection with a triple-core wire is described as the example and thus three guide grooves 19 and three protrusions 5 are provided. However, the structure of the present invention can be also adapted entirely to the electric connection with other wires, such as a double-core wire or a four-core wire, by changing the numbers of the guide grooves 19 and protrusions 5.

EMBODIMENT 2

FIGS. 13–20 show the second embodiment of the present invention. FIGS. 13–15 show that the metallic contacts 21 of a socket (in the embodiment, it is a multifuntional outlet) are contacted with the metallic contacts 24 of a plug.

In comparison with the above embodiment, the difference is that in the present embodiment the coupling member used as the socket 1 has several needles and, therefore, can provides several plug-in holes for simultaneous connection with several plugs. The structure will be briefly described below.

Each plug 2 has an inserting pin 18. Along the outer peripheral surface of the inserting pin 18, there are two or three J-shaped guide grooves 19. At the bottom end of the curved section of each J-shaped groove 19, a metallic contact 24 is arranged. Several inserting members 4 each has an inserting pin hole 22, protrusions 5 and metallic contacts B21 which each attaches on one section of the outer peripheral surface of the respective protrusion 5, and is integrated with a socket cover 15. Stepped needles 12 are formed on the socket box 30 with the springs 10 therearound, and each needle 12 has a base with lager diameter for retaining one end of the spring 10 so as to fix the spring 10 on the needle 12 firmly. Clamping screws 8 are used to connected a wire 6 with the clamping nuts 9 which each has been integrated with a metallic conductor piece 7 of the socket by soldering. The socket cover 15 and the socket box 30 are connected together by coupling screws 14. In addition, in FIG. 15, the metallic conductor pieces of the plug 2 is designated by the reference numeral 17. In FIG. 20, the soldering spots are designated by the reference numeral 20 and the pin hole by the reference numeral 23.

During the operation of the electric connector according to the embodiment, the operator can hold a plug 2, and under the guidance of the grooves 19, inserts the plug 2 into the socket 1 until the spring 10 contacts against the front end of the plug 2. Then the operator applies a pressure so as to have the spring 10 compressed. When the protrusions 5 reach the bottom ends of the straight sections of the grooves 19, along the paths provided by the curved sections of the grooves 19, the plug 2 is rotated in relation to the socket 1 until the rotrusions 5 reach the bottom ends of the curved sections of the grooves 19. Then the pressure applied on the plug 2 is released. Under the action of the recovery force of the spring 10, the plug 2 is forced to move back so as to make the metallic contacts 24 and the metallic contacts 21 to contact with each other, whereby the electric power is turned on.

When the plug is required to be taken off, the operator can hold the plug by hand and applies pressure to push it, making the contacts 24 to leave the contacts 21. Then according to the reverse sequence of the above mentioned steps, the plug 2 can be pulled out from the socket 1.

As mentioned in the above embodiment, the electric connector according to the present invention can be adapted to the electric connection not only with a double-core wire but also with a triple-core wire (FIGS. 18, 19), and the difference is merely in the numbers of the guide grooves 19 and protrusions 5.

EMBODIMENT 3

FIGS. 21–23 show the third embodiment of the present invention, in which the metallic contacts 21 of a socket (in the embodiment, it is a cassette socket) are contacted with the metallic contacts 24 of a plug.

In comparison with the embodiment 2, the difference is merely in that the socket of the present embodiment is attached in the wall of a building. Therefore the structure of the body of the socket box is somewhat changed. Its whole structure will be briefly described as below.

A plug 2 has an inserting pin 18. Along the outer surface of the inserting pin 18, there are J-shaped guide grooves 19. At the bottom end of the curved section of each J-shaped groove 19, a metallic contact 24 is arranged. An inserting member 4 has an inserting pin hole 22, protrusions 5 formed in the inserting pin hole, and metallic contacts 21 which each attaches on one section of the peripheral surface of the respective protrusion 5, and is integrated with a socket cover 15. Needles 12 are integrally formed on the socket box 30. The spring 10 is fitted around each of the needles 12 and is firmly fixed on it. Clamping screws 8 are used for connecting wires 6 with the clamping nuts 9 which each is integrally soldered on a metallic conductor piece 7. The relative position between the socket cover 15 and the socket box 30 is defined by guide blocks 32 and they are fixed together by coupling screws 14. The operation of the socket and the plug in the present embodiment is the same as that in the embodiment 2, and the description thereof will be omitted. In addition, in FIG. 21, the wall of the building is designated by the reference numeral 31.

EMBODIMENT 4

FIGS. 24–59 show the fourth embodiment of the present invention, in which both the socket and the plug are of a structure having an inserting member as well as an inserting pin. The structure of this embodiment will be described as below.

In the embodiment, in similar way to the above embodiments, the inserting pin 18 (FIG. 45) has J-shaped guide grooves 19'. At the end of the curved section of each J-shaped groove 19', a metallic contact 24' is arranged. The inserting member 4 (FIG. 28) has an inserting pin hole 22, protrusions 5 and metallic contacts 21. As shown in FIGS. 24, 25, in the embodiment, both the socket and the plug each has an inserting pin and an inserting member. However, it should be noted that, comparing the inserting member 4 (FIG. 28) at the outside of the socket 1 with the inserting pin 18 (FIG. 45) at the outside of the plug 2, the structures of both elements are similar except that the inserting member 4 of the socket 1 has protrusions while the inserting pin 18 of the plug 2 has J-shaped guide grooves. Similarly, comparing the inserting member 4' (FIG. 50) at the inside of the plug 2 with the inserting pin 18' (FIG. 32) of the socket 1, except that the inserting member 4' of the plug 2 has protrusions and the inserting pin 18' of the socket 1 has J-shaped guide grooves, the structures of both elements are similar. In the hole of the inserting pin 18 of the plug 2, the inserting member 4', an insulating positioner 40, an outer conductor coupling damper 41, an outer conductor contacting member 42, a gasket plate 43, a rubber gasket 44 and a clamping positioner 45 are provided in sequence. In the hole 22 of the inserting member 4 of the socket 1, the inserting pin 18', a stepped outer insulating positioner 33, an inner insulating positioner 34, an outer conductor coupling damper 35, an outer conductor contacting member 36, a gasket plate 37, a rubber gasket 38 and a clamping positioner 39 are provided in sequence. A spring 10 is fitted around the outer insulating positioner 33 and the inserting pin 18' which functions as the needle base in the above mentioned embodiments. One end of the spring 10 is securely fixed on the positioner 33.

In the socket 1, one end of a coaxial cable 6 passes through the inlet wire hole 16 (FIG. 44) of the clamping positioner 39 and the central holes of the rubber gasket 38, the gasket plate 37, the outer conductor contacting member 36 and the outer conductor coupling damper 35 in sequence. The outer conductive layer of the coaxial cable 6 is connected electrically with the outer conductor contacting member 36, and the inner conductor 46 (FIG. 24) of the coaxial cable 6 is inserted into the inner conductor hole 50 (FIG. 32) of the metallic inserting pin 18' so as to be electrically connected with the inserting pin 18' by soldering in the soldering paste hole 49 (FIG. 32). The inserting pin 18' and the inner insulating positioner 34 are arranged within the outer insulating positioner 33. The outer insulating positioner 33 is fixed in a groove 51 (FIG. 28) of the inserting member 4 and is positioned fixedly in relation to the inserting member 4. One end of the spring 10 is securely attached on the positioner 33. The outer conductor coupling damper 35 electrically connects the metallic conductor pieces 7 of the socket with the outer conductor contacting member 36. The clamping positioner 39 clamps the pin 18', the outer insulating positioner 33, the inner insulating positioner 34, the outer conductor coupling clamper 35, the outer conductor contacting member 36, the gasket plate 37 and the rubber gasket 38 with thread 48, 47, and clamp them in the inserting member 4.

In the plug 2, one end of another coaxial cable 6' passes through the inlet wire hole 16' of the clamping positioner 45 and the central holes of the rubber gasket 44, the gasket plate 43, the outer conductor contacting member 42 and the outer conductor coupling damper 41 in sequence. The outer conductive layer of the coaxial cable 6' is connected electrically with the outer conductor contacting member 42, and the inner conductor 46' of the coaxial cable 6' is inserted into the inner conductor hole 50' of the metallic inserting member 4' so as to be electrically connected with the inserting member 4' by soldering in the soldering paste hole 49' (FIG. 50). The inserting member 4' and the insulating positioner 40 are matched together in the groove 51 ' (FIG. 45) of the inserting pin 18 so as to be positioned in relation to the inserting pin 18. The outer conductor coupling damper 41 electrically connects the metallic conductor pieces 17' of the plug with the outer conductor contacting member 42. The clamping positioner 45 clamps the inserting member 4', the insulating positioner 40, the outer conductor coupling damper 41, the outer conductor contacting member 42, the gasket plate 43 and the rubber gasket 44 by means of thread 48', 49', and positions them in the inserting pin 18.

During the operation of the electric connector according to this embodiment, the operator can hold the socket 1 and the plug 2, and under the guidance of the grooves 19, 19', has the inserting pins 18, 18' moved respectively into the inserting pin holes 22, 22' until the spring 10 contacts against the front end surface of the plug 2. Then the operator applies a pressure so as to compress the spring 10. When the protrusions 5, 5' have been pushed to the bottom ends of the straight sections of the grooves 19, 19', along the paths provided by the curved sections of the grooves 19, 19', the plug 2 is rotated until that the protrusions 5, 5' abut respectively on the bottom ends of the curved sections of the grooves 19, 19'. Then the pressure is released. Under the action of the recovery force of the spring 10, the plug 2 is forced to return so as to make the metallic contacts A and the metallic contacts B to contact with each other, whereby the electric power is turned on.

When the plug is required to be taken off, the operator can hold the plug by hand and applies pressure on it, making the contacts A to leave the contacts B. Then, according to the reverse sequence of the above mentioned steps, the plug 2 can be pulled out from the socket 1.

While the description of the invention has been given with respect to the preferred embodiments, it is not to be constructed in a limited sense. Variations and modification will occur to those skilled in the art. Reference is made to the appended claims for a definition of the invention.

I claim:

1. An eloctic connector comprising;

a first coupling member and a second coupling menber adapted to be fitted with said first member, wherein said second coupling member comprises an inserting pin, said inserting pin having a front end and a plurality of guide grooves are formed on the outer peripheral surface of said inserting pin, each of which includes a straight section and a curved secton connected with said straight section, said straigbt section extending from said front end of said insertng pin; wherein said curved section connected at an end of said straight section away from said front end of said inserting pin, and wherein a metallic contact is arranged at the end of each of said curved sections, away from said straight section;

said first coupling menbcr comprising an inserting member having a socket to receive said inseting pin, a plulity of protrusions formed in said socket and extending radiaily, wherein metallic contacts are provided to attach around one section of the peripheral surface of each of said protrusions, said metallic contacts facing oppositely in the opening of said socket;

wherein a pinhole is formed in said inserting pin, a needle base having a stepped needle being formed in the socket and adapted to be inserted into the pinhole, a spring being seated around the needle with one end fixed in said socket; pressure being applied on the spring by the front end of the inserting pin and the spring biasing the inserting pin when said needle is inserted into said hole so that said members are in a firm electric connection condition;

said protrusions in said socket being guided by said guide grooves of said second coupling member so as to guide the connection of said inserting pin with said second coupling member, the metallic contacts of said protrusions electrically engage the metallic contacts of the grooves when said first coupling member is inserted into said second coupling member and are connected with each other.

2. An electric connector as claimed in claim 1, wherein said first coupling member has a plurality of said inserting members.

3. An electric connector as claimed in claim 1, wherein said grooves are in shape of J, U or L.

4. An electric connector as claimed in claim 1, wherein a socket cover and a socket box are used for enclosing said inserting member and said needle base.

* * * * *

UNITED STATES PATENT AND TRADEMARK OFFICE

CERTIFICATE OF CORRECTION

PATENT NO. : 6,022,235
DATED : February 8, 2000
INVENTOR(S) : Ning Zhang

It is certified that error appears in the above-identified patent and that said Letters Patent is hereby corrected as shown below:

In column 3, line 59, change "wre" to - - core - -.
In column 4, line 24, change "damper" to - - clamper - -.
In column 4, line 52, change "eamper" to - - clamper - -.
In column 5, line 33, change "is" to - - faces - -.
In column 7, line 10, change "rotrusions" to - - protrusions - -.
In column 8, line 20, change "damper" to - - clamper - -.
In column 8, line 26, change "damper" to - - clamper - -.
In column 8, line 37, change "damper" to - - clamper - -.
In column 8, line 51, change "damper" to - - clamper - -.
In column 8, line 63, change "damper" to - - clamper - -.
In column 9, line 6, change "damper" to - - clamper - -.

Signed and Sealed this

Eighth Day of May, 2001

*Attest:*

Nicholas P. Godici

NICHOLAS P. GODICI

*Attesting Officer*

*Acting Director of the United States Patent and Trademark Office*